US009297108B2

(12) United States Patent
Cuppini et al.

(10) Patent No.: US 9,297,108 B2
(45) Date of Patent: Mar. 29, 2016

(54) MACHINE AND METHOD FOR DRYING CLEANING ARTICLES

(75) Inventors: Gabriele Cuppini, Bologna (IT); Fulvio Nuzzo, Bentivoglio (IT)

(73) Assignee: F.M.B. FABBRICA MACCHINE BOLOGNA S.p.A. (IT)

( * ) Notice: Subject to any disclaimer, the term of this patent is extended or adjusted under 35 U.S.C. 154(b) by 499 days.

(21) Appl. No.: 13/810,424

(22) PCT Filed: Jul. 25, 2011

(86) PCT No.: PCT/IB2011/053312

§ 371 (c)(1), (2), (4) Date: Feb. 6, 2013

(87) PCT Pub. No.: WO2012/014148

PCT Pub. Date: Feb. 2, 2012

(65) Prior Publication Data

US 2013/0198973 A1 Aug. 8, 2013

(30) Foreign Application Priority Data

Jul. 26, 2010 (IT) ..... BO2010A0473

(51) Int. Cl.

*D06F 25/00* (2006.01)
*D06F 37/00* (2006.01)
*D06F 43/02* (2006.01)

(Continued)

(52) U.S. Cl.

CPC ..... *D06F 43/02* (2013.01); *D06F 43/04* (2013.01); *D06F 43/086* (2013.01)

(58) Field of Classification Search

CPC ..... D06F 43/00; D06F 43/08; D06F 25/00; D06F 35/00

USPC ..... 8/142, 159; 68/5 C, 12.18, 17 R, 207, 68/209

See application file for complete search history.

(56) References Cited

U.S. PATENT DOCUMENTS

| | | | | |
|---|---|---|---|---|
| 3,239,945 | A | 3/1966 | Cobb et al. | |
| 6,243,969 | B1 | 6/2001 | Yeazell | |
| 2005/0183208 | A1 * | 8/2005 | Scheper | D06F 25/00 8/142 |

FOREIGN PATENT DOCUMENTS

| | | |
|---|---|---|
| CN | 1032114 | 4/1989 |
| EP | 0103228 | 3/1984 |
| EP | 1528140 | 5/2005 |

(Continued)

OTHER PUBLICATIONS

International Search Report and Written Opinion from counterpart PCT application PCT/IB11/053312.

(Continued)

*Primary Examiner* — Gregory R DelCotto
*Assistant Examiner* — Preeti Kumar
(74) *Attorney, Agent, or Firm* — Timothy J. Klima; Shuttleworth & Ingersoll, PLC

(57) ABSTRACT

A dry cleaning machine for articles such as garments and the like, comprises: a rotary drum for containing the articles; means for feeding a solvent into the drum; means for draining a solvent out of the drum; a closed circuit for circulating air for drying the articles inside the drum, comprising at least one air movement fan, means for driving the fan, a heating device for heating the air to be fed into the drum, an air cooling device for condensing the solvent contained in the air flowing out of the drum.

17 Claims, 2 Drawing Sheets

(51) Int. Cl.
*D06F 43/04* (2006.01)
*D06F 43/08* (2006.01)

(56) References Cited

FOREIGN PATENT DOCUMENTS

| | | |
|---|---|---|
| GB | 932564 | 7/1963 |
| JP | 11244589 | 9/1999 |
| WO | 2008/032997 | 3/2008 |

OTHER PUBLICATIONS

Office Action issued by the Intellectual Property Office of the People's Republic of China dated Dec. 3, 2014 for corresponding application No. 201180036113.1.

* cited by examiner

MACHINE AND METHOD FOR DRYING CLEANING ARTICLES

This application is the National Phase of International Application PCT/IB2011/053312 filed Jul. 25, 2011 which designated the U.S. and that International Application was published under PCT Article 21(2) in English.

This application claims priority to Italian Patent Application No. BO2010A000473 filed Jul. 26, 2010 and PCT Application No. PCT/IB2011/053312 filed Jul. 25, 2011, which applications are incorporated by reference herein.

TECHNICAL FIELD

This invention relates to a machine and a method for the dry-cleaning of articles, in particular articles such as garments, bedroom and bathroom linen, curtains and the like.

BACKGROUND ART

A new solvent for dry-cleaning machines, particularly effective for cleaning garments and at once relatively eco-friendly, has recently been introduced into the market.

This solvent is identified by the registered name Methylenebis(oxy)dibutane, the name Dibutoxymethane or the CAS number: 2568-90-3.

Garments cleaned with this innovative solvent give off a strong odour, even if the residual concentration of the solvent on the garments on completion of the cleaning cycle is low.

A strongly felt need, therefore, is that of minimizing, or in any case reducing below minimum acceptable levels, the concentration of residual solvent in the garments at the end of the cleaning cycle.

Dry-cleaning machines are known which comprise a rotary drum for containing the garments, means for feeding and draining the solvent and a closed circuit for circulating air for drying the articles and configured to allow air to flow through the drum.

These machines are furnished with a fan for circulating the air in the closed circuit, a device for heating the air and a device for cooling the air.

Prior art dry-cleaning machines cannot reduce the concentration of the solvent on the garments to acceptable levels. Thus, one disadvantage connected with the use of innovative solvents in these machines is that of not being able to eliminate the odour which the solvent leaves on the garments at the end of the cleaning cycle.

DISCLOSURE OF THE INVENTION

This invention therefore has for an aim to satisfy the above mentioned need and to overcome the stated disadvantage through a dry-cleaning method and machine that allow the concentration of residual solvent at the end of the cleaning cycle to be greatly reduced.

Another aim of the invention is to provide a dry-cleaning method and machine which can optimize the duration of the step of drying the articles.

According to the invention, these aims are achieved in a machine and a method for the dry-cleaning of articles and comprising the technical features described in one or more of the appended claims.

BRIEF DESCRIPTION OF THE DRAWINGS

The technical features of the invention, with reference to the above aims, are clearly described in the claims below and its advantages are more apparent from the detailed description which follows, with reference to the accompanying drawings which illustrate a preferred, non-limiting example embodiment of the invention and in which:

DETAILED DESCRIPTION OF THE PREFERRED EMBODIMENTS OF THE INVENTION

Figure 1:
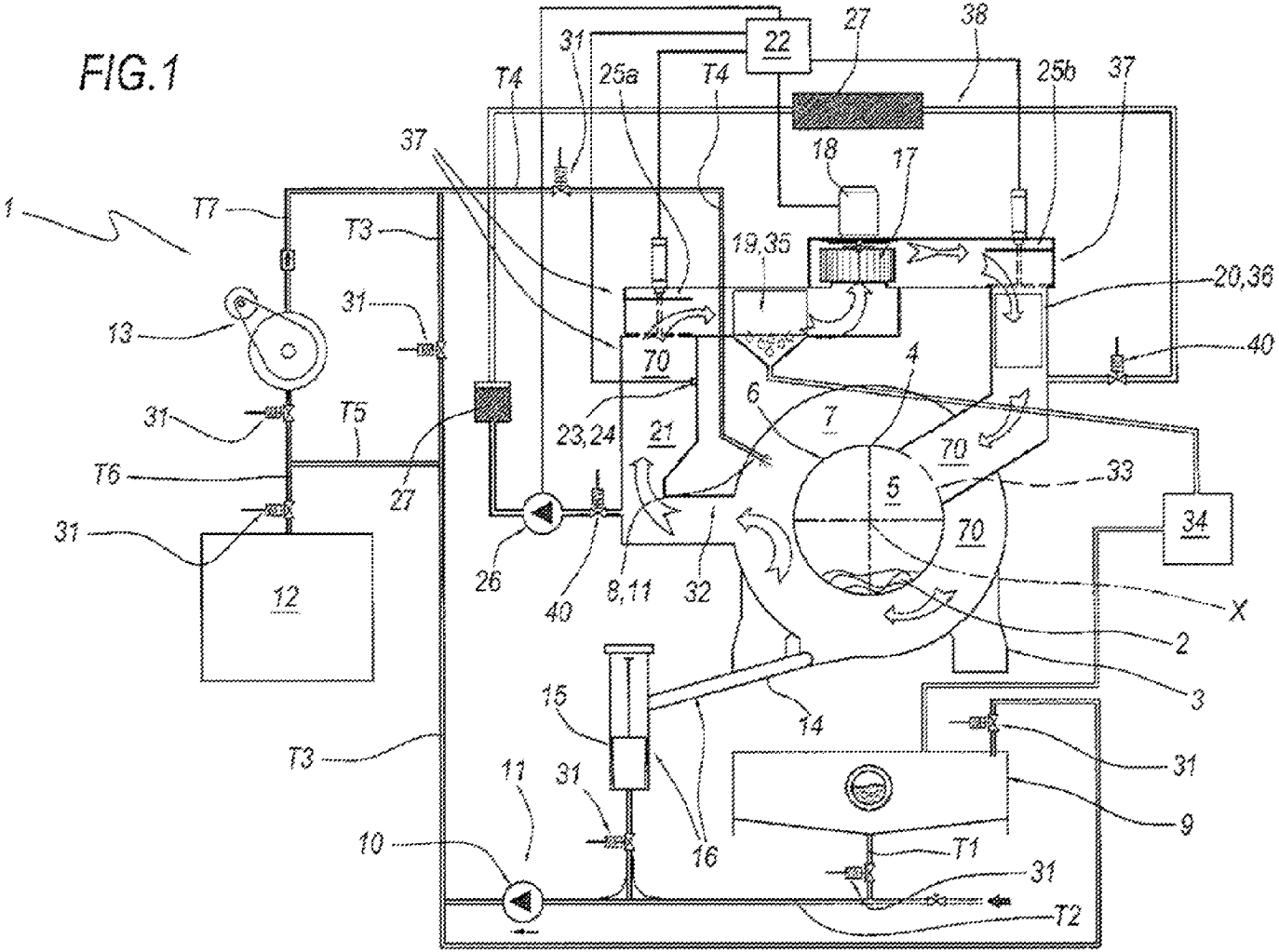
FIG. 1 schematically represents a dry-cleaning machine according to this invention.
Figure 2:
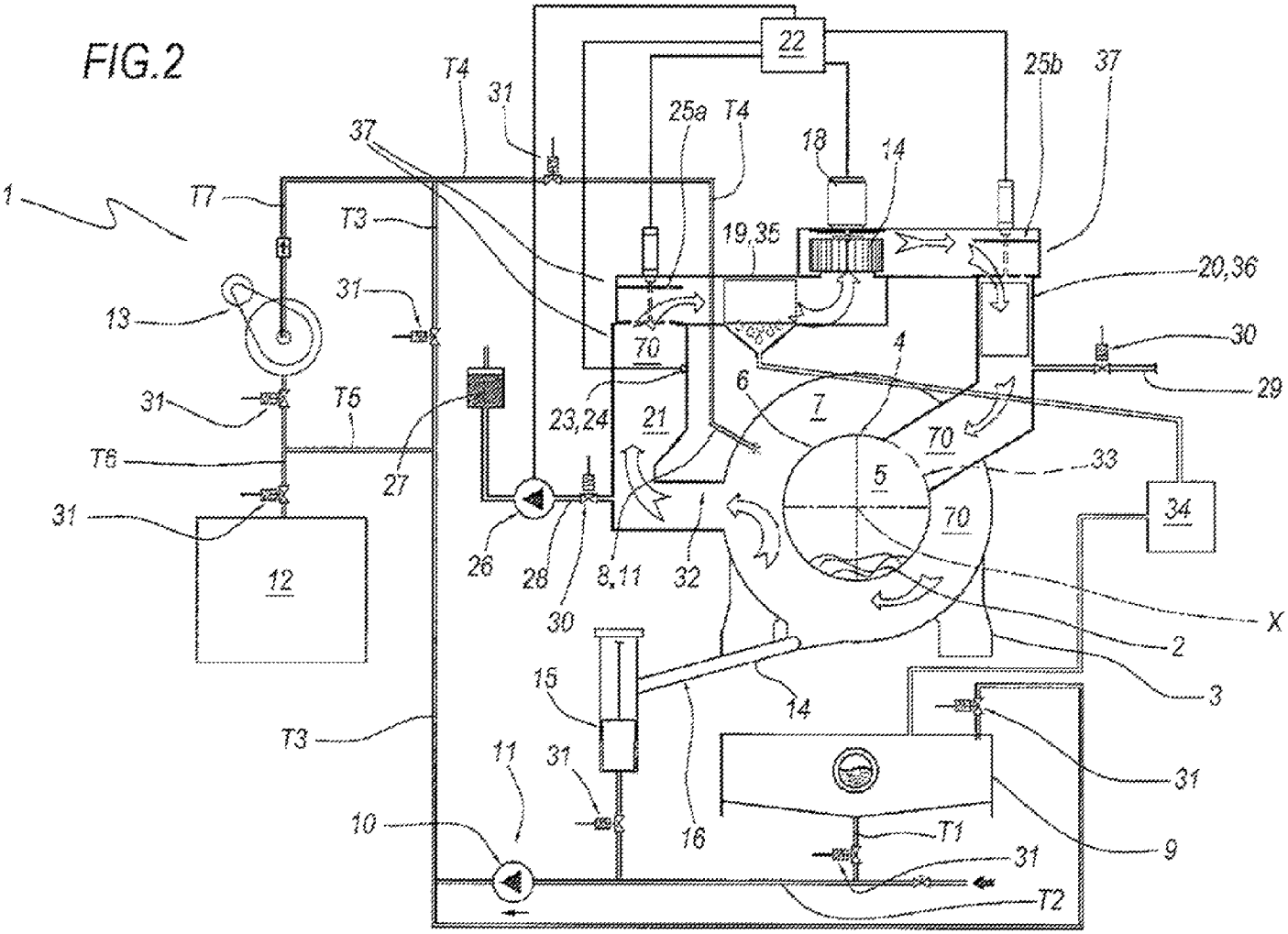
FIG. 2 schematically represents the dry-cleaning machine of FIG. 1 according to a variant embodiment of the invention.

With reference to FIGS. 1 and 2, the reference numeral 1 denotes in its entirety a dry-cleaning machine made according to this invention.

It should be noted that FIGS. 1 and 2 show respective functional diagrams of the dry-cleaning machine 1.

The reference numeral 2 denotes a generic article to be dry-cleaned.

The dry-cleaning machine 1 is designed preferably to clean garments, bedroom and bathroom linen, curtains and the like. This must be considered by way of an example only since the machine 1 is quite versatile and able to wash articles 2 other than those mentioned.

The terms articles 2 or garments 2 will hereinafter be used without distinction.

Preferably, the solvent used in the machine 1 is an innovative solvent known by the registered chemical trade name Methylenebis(oxy)dibutane, the name Dibutoxymethane or the CAS number: 2568-90-3.

Indeed, the use of this innovative type of solvent in the machine 1 advantageously gives optimum results in cleaning the garments 2 while having a particularly low impact on the environment.

It will be understood, however, that the above must not be considered as limiting the invention. In effect, a different kind of solvent might also be used in the machine 1.

The machine 1 comprises a mounting frame 3.

The machine also comprises a drum 4 for containing the articles 2 to be dry-cleaned.

The drum 4 has an opening, not illustrated in FIG. 1, through which the articles are loaded and unloaded.

The drum 4 is mounted rotatably on the frame 3.

It should be noted that the drum 4 is configured to rotate about an axis denoted by the reference character X.

The drum 4 is driven in rotation by drive means of substantially known type (not illustrated in FIG. 1).

Preferably, the drum 4 is cylindrical in shape, that is to say, it defines a cylindrical space 5 for containing the articles 2.

According to another aspect, the drum 4 has a plurality of through holes (not illustrated) made in its lateral surface 6 designed to allow solvent to flow into the article containment space 5 of the drum 4.

It should be noted that the drum 4 is accommodated in a corresponding housing 7 defined by the frame 3.

The machine 1 further comprises a plurality of nozzles 8 for feeding solvent into the article 2 containment space 5, that is to say, into the interior of the drum 4.

Alternatively to the nozzles 8, the machine might comprise one or more pipes for feeding the solvent directly into the housing 7 of the drum 4.

Thus, more in general, the nozzles, or the pipes, constitute means 8 for releasing the solvent into the drum 4.

The solvent is contained in a tank 9 also forming part of the machine 1.

The tank 9 is connected to the releasing means 8 by way of a solvent supply duct whose different stretches are labelled T1, T2, T3 and T4.

A pump 10 is mounted along the solvent duct to allow the solvent to circulate.

The pump 10, the supply duct and the releasing means 8 together constitute means 11 for feeding the solvent into the drum 4.

According to another aspect, the machine 1 further comprises a solvent distillation unit 12.

The distillation unit 12 is connected preferably to the solvent tank 9 by way of a duct whose stretches are labelled T2, T3, T5 and T6.

According to yet another aspect, the machine 1 further comprises a solvent filtration unit 13 by which the solvent is filtered and any impurities in it removed.

It should be noted that the solvent can be fed from the tank 9 to the drum 4 also through a circuit defined by the duct stretches T2, T3, T5, T7 and T4 and which the filtration unit 13 also forms part of.

According to this aspect, the solvent is filtered by the filtration unit 13 before being released into the drum 4 by the releasing means 8.

It should be noted that during the cleaning cycle, the solvent is recycled through a drain 14 and a filtration device 15, also known as button trap.

The drain 14 and the filtration device 15 together constitute means 16 for draining the solvent out of the drum 4.

Advantageously, the solvent drained out of the drum 4 is channeled back into the solvent tank 9 or, alternatively, is channeled to the distillation unit 12 for purification.

In a known manner not described in detail here, a plurality of valves 31 which can be opened and closed in suitable relation to each other, allow the solvent to follow one path or another, as required. According to this aspect, the same pump 10 may allow the solvent to be transferred to the drum 4, to the distillation unit 12, to the solvent filtration unit 13 or to the tank 9.

According to embodiments not illustrated in the drawings, the machine 1 may also be configured in such a way that the different solvent paths remain independent of each other, that is to say, do not have any duct stretches in common.

According to the invention, the machine 1 comprises a fan 17, means 18 for driving the fan, and an air circulation duct 21.

The air circulation duct 21 is connected to the housing 7 of the drum 4 in such a way as to form a closed air circulation circuit 37 passing through the selfsame drum 4.

The reference numeral 32 in FIG. 1 denotes the extraction opening of the duct 21 through which the air flows out of the housing 7 and the numeral 33 denotes the inlet opening of the selfsame duct 21 through which the air flows back into the housing 7.

The fan 17 is designed to make an airflow circulate along the closed path defined by the duct 21, that is to say, it provides the necessary pressure head to the air to circulate.

The drive means 18 preferably comprise an inverter designed to allow the rotation speed of the fan 17 itself to be varied.

According to the invention, the machine 1 also comprises an evaporator 19 of a refrigerating system located in the closed circuit 37 in which the air circulates through the drum 4.

The evaporator 19 cools the air flowing in the closed circuit 37 so that the solvent contained in the air condenses.

The solvent condensed in the evaporator 19 is collected and channeled to a separator 34, which also forms part of the machine 1 and in which the solvent is separated from the water.

The evaporator 19 of the refrigerating system is located inside the air circulation duct 21, preferably upstream of the fan 17 relative to the direction in which the air flows inside the duct 21.

It should be noted that, in more general terms, the evaporator 19 constitutes, according to the invention, an air cooling device 35.

According to the invention, the machine 1 also comprises a condenser 20 of a refrigerating system located in the closed circuit 37 in which the air circulates through the drum 4.

The condenser 20 is designed to heat the air to be fed into the drum 4.

The condenser 20 of the refrigerating system is located inside the air circulation duct 21, preferably downstream of the fan 17 relative to the direction in which the air flows inside the duct 21.

The condenser 20 and the evaporator 19 preferably form part of the same refrigerating system.

It should be noted that, in more general terms, the condenser 20 constitutes, according to the invention, an air heating device 36.

It should be noted that according to the invention, the air circulation duct 21, the fan 17, the drive means 18 of the fan 17, the evaporator 19 and the condenser 20 form part of a closed circuit 37 for circulating air for drying the articles 2.

It should also be noted that in the closed circuit 37 the air used for drying is heated in the condenser 20, transferred through the drum 4 and then cooled by the evaporator 19.

According the invention, the machine 1 comprises a sensor 24 designed to detect the values of solvent concentration in the air.

The sensor 24 is preferably mounted inside the drying air circulation duct 21.

The sensor 24 is preferably mounted upstream of the evaporator 19 relative to the direction of air flow in the duct 21.

It should be noted that the value of solvent concentration in the air is positively correlated with the value of solvent concentration on the garment 2. In other words, a low value of solvent concentration detected in the air corresponds to a low value of solvent concentration on the garment 2, and a high value of solvent concentration detected in the air corresponds to a high value of solvent concentration on the garment 2.

More in general, the sensor 24 constitutes means 23 for detecting the value of solvent concentration in the drying air.

According to the invention, the machine 1 comprises a control unit 22, connected to the drive means 18 of the fan 17 and to the means 23 for detecting the value of solvent concentration in the drying air.

In other words, the control unit is defined by an on-board computer associated with the machine 1.

As will become clearer as this description continues with reference to the operation of the machine 1, the control unit 22 is programmed, according to the invention, to regulate the rotation speed of the fan 17 as a function of the value of solvent concentration in the drying air detected by the sensor 24.

The control unit 22 is preferably also programmed to control the opening and closing of the valves 31 in suitable relation to each other according to the different steps of machine operation.

According to another aspect of the invention, the machine 1 comprises a pair of closing elements 25*a*, 25*b* which are movable for the sealed closing of a portion 70 of the closed circuit 37 in which the drying air circulates.

The closing elements 25*a*, 25*b* are movable between two end positions: an open position (illustrated by continuous lines in FIG. 1), where they allow the alt to flow in the air circulation duct 21, and a closed position (illustrated by dashed lines in FIG. 1), where they prevent the air from flowing in the air circulation duct by occluding the duct 21 itself.

The closing elements 25*a*, 25*b*, when they are in the closed position, allow the machine 1 housing 7 containing the drum 4 to be sealed off.

It should be noted that, in more general terms, the closing elements 25*a*, 25*b* allow sealed closing of a portion 70 of the dosed air circulation circuit 37 comprising the drum 4 and excluding the evaporator 19.

The closing elements 25*a*, 25*b* thus constitute means for closing a portion 70 of the closed circuit 37 for the circulation of the drying air.

In the first embodiment of FIG. 1, by way of non-limiting example, a first closing element 25*a* is located along the air circulation duct 21 upstream of the evaporator 19 and a second closing element 25*b* is located along the air circulation duct 21 downstream of the fan 17.

Preferably, the closing elements 25*a*, 25*b* are connected to the control unit 22 so they can be activated for opening/closing by the control unit 22 as required during the cleaning cycle, as described in more detail below.

According to another aspect of the invention, the machine 1 comprises a closed air circulation circuit 38 comprising an extractor 26 and a pair of carbon filters 27.

The extractor is preferably connected to the control unit 22 so that it can be activated by the latter at the required step in the cleaning cycle.

The extractor 26 causes the air to circulate along the closed path defined by the secondary closed circuit 38 in order to condition the air inside the housing 7 of the machine 1.

Preferably, the secondary circuit 38 can be opened/closed by a pair of valves 40.

In effect, the air is purified by the carbon filters 27 which, according to the invention, constitute air filtration means.

The technical and functional features of the secondary closed circuit 38 are described in more detail below.

Alternatively to the secondary closed circuit 38 for air circulation, the machine 1, as illustrated in FIG. 2, comprises a duct 28, through which air is extracted from the housing 7 and which gives onto the outside environment, and a duct 29 through which air from the outside environment is fed into the housing 7.

An extractor 26 is positioned to operate along the air extraction duct 28.

It should be noted that in this embodiment, both the ducts 29, 28 for extracting air from, and feeding air into, the housing 7 are equipped with valves 30 which allow the ducts 29, 28 themselves to be closed/opened.

Preferably, the valves 30 are activated by the control unit 22 at the required step in the cleaning cycle, as described in more detail below.

Described below is the operation of the machine 1 according to the invention with reference to a cleaning cycle in a preferred operating mode.

The machine is quite versatile and the description given below must therefore be considered by way of example only to facilitate understanding of machine operation and advantages and to clarify certain technical and functional aspects.

The control unit 22 sets the drum 4 in rotation and, to start a cleaning cycle, controls the feeding of the solvent into the drum 4 using the solvent feed means 11.

The rotation of the drum 4 allows the solvent to be well distributed and optimizes the cleaning of the garments 2.

Once cleaning operations have been completed, the articles 2 must be dried in order to remove from them the liquid solvent used to clean them.

The control unit 22 thus sets the closing elements 25*a*, 25*b* to the open position and starts the fan 17 drive means 18 in order to set the fan 17 in rotation.

The fan 17 allows an air flow to circulate in the closed circuit 37 for the circulation of the drying air which is heated at the condenser 20 and cooled at the evaporator 19. The air comes into contact with the garments 2 inside the drum 4, causing the solvent on them to evaporate and thus drying them.

Preferably, the air is heated by the condenser 20 in such a way that it is fed into the drum 4 at a temperature of between 60° C. and 85° C., and still more preferably, between 65° C. and 75° C.

The hot air strikes the garments 2 in the drum 4 and carries the solvent away with it in the form of vapour.

Downstream of the drum 4, the air, dense with vapour, comes into contact with the evaporator 19 which causes the vapour to condense.

The evaporator 19 allows heat to be removed from the air, causing the vapour to condense, that is to say, causing the solvent to pass from vapour to liquid state.

Thus, downstream of the evaporator 19, is at a lower temperature than it is upstream of the evaporator 19.

The solvent condensed in the evaporator 19 is collected and channeled to the separator 34 in which the solvent is separated from the water and other liquid substances, if any, making up the cleaning liquid.

The solvent recovered is channeled into the tank 9, advantageously allowing it to be re-used in subsequent cleaning cycles.

If the solvent has a high concentration of impurities and/or dirt, it can be directed to the distillation 12 and/or to the filtration unit 13.

In the preferred mode of operation, there is a step of driving the fan 17 at a predetermined rotation speed w1, that is to say, at a first speed value w1.

This step allows the garments 2 to be dried very quickly by condensing most of the solvent present in the drum 4, on the garments 2 and in the housing 7.

In effect, the flow rate of the air in the closed circuit 37 is relatively high and allows the garments 2 to be dried relatively quickly.

Generally speaking, it should be noted that the speed of rotation of the fan 17 is correlated with the air flow rate in the closed circuit 37. In more general terms, therefore, the rotation speed of the fan 17 corresponds to the air circulation speed in the closed circuit 37.

This step, however, although it optimizes the duration of the drying cycle, does not allow the concentration of the solvent in the air to be reduced below certain values.

According to the invention, therefore, the control unit 22 reduces the speed of the fan 17 when it detects, through the sensor 24, a predetermined value of solvent concentration c1 in the air.

Preferably, the control unit 22 progressively reduces the rotation speed of the fan 17 upon reaching the predetermined value of solvent concentration c1 in the air.

Reducing the rotation speed of the fan 17 allows the flow rate of the air circulating in the closed circuit 37 to be reduced, thereby lowering the temperature of the air flowing out of the evaporator 19.

Preferably, in this step of reducing the speed, the temperature of the air flowing out of the evaporator 19 decreases to levels even lower than −10° C., and still more preferably to a level below −15° C.

At these temperatures, the evaporator 19 condenses in a particularly effective manner the solvent removed from the garments 2 and present in the air in the form of vapour, allowing the quantity of residual solvent on the garments 2 to be reduced to particularly low levels.

In a preferred mode of operation, there is a step of reducing the rotation speed of the fan 17 to a predetermined second speed value w2.

Further, preferably, the rotation speed of the fan 17 is maintained at a predetermined second speed value w2, corresponding to the minimum rpm of the fan 17.

It was found through experiments that the rotation speed w2 of the fan corresponds to an air flow rate along the closed circuit 37 that is approximately ¼ of that at the speed w1 of the fan.

The fan 17 is driven in rotation at the second rotation speed w2 for a predetermined length of time or until a predetermined value of solvent concentration in the air is detected, corresponding to a significant reduction in the concentration of the solvent on the garments.

Advantageously, the steps in the drying cycle described above make it possible to effectively dry the garments 2 and to remove the solvent from the garments 2 in such a way that, at the end of the drying cycle, the quantity of residual solvent on the garments is minimal.

Preferably, at the end of the operations described above, the control unit 22 switches the closing elements 25*a*, 25*b* from the open position to the closed position in such a way as to seal off the housing 7 from the evaporator 19.

This, advantageously prevents backflow/evaporation of the solvent present at the evaporator 19, allowing the solvent concentration on the garments 2 to remain at the particularly low levels obtained with the drying cycle described above.

Further, in the preferred embodiment of FIG. 2, the air in the secondary circuit 38 is recirculated before the operator gains access to the drum 4. This allows the air in the housing 7 to be suitably conditioned even in the event of a fault in the closed drying circuit 37, which would lead to high levels of solvent concentration in the air.

In other words, the secondary closed circuit 38 conditions the air before the door giving access to the drum 4 is opened, thereby preventing the operator from coming into contact with air whose solvent concentration levels are too high.

It should be noted that the closing elements 25*a*, 25*b* are set to the closed position during air recirculation in the secondary circuit.

In a variant embodiment, the machine 1 is not provided with the sensor 24.

In this variant embodiment, the rotation speed of the fan 17 is not varied as a function of the detected value of the solvent concentration in the closed circuit 37 (that is, feedback regarding the value of concentration in the air) but is varied according to a predetermined timing scheme known in the technical jargon of the trade as "open control".

The timing scheme is derived from statistical values of expected concentrations of solvent in the drying air, that is, on the garments 2, after the fan 17 has been in operation for a predetermined length of time, these values being the result of experimental measurements.

By way of non-limiting example, the machine 1 runs at the rotation speed w1 for a certain first time interval t1 and at the rotation speed w2 for a certain second time interval t2.

Thus, the steps described above with reference to the machine 1 equipped with the sensor 24 are not performed as a function of a measured or detected value of solvent concentration but as a function of a time interval corresponding to a certain assumed or expected value of solvent on the garment 2.

It should be noted that in this variant embodiment, there is a set-up step in which the time intervals t1, t2 are set. Preferably, during this step, the values of solvent concentration in the air are measured and the related timing scheme is determined in order to optimize the operation of the machine 1.

Hence, the expression "certain concentration value" is hereinafter used to mean a concentration value found using the detecting means or an expected concentration value (found experimentally, for example).

This variant embodiment falls within the scope of this invention.

The invention also defines a method for the dry-cleaning of articles 2, comprising the following steps:

- feeding a solvent into a drum 4 for containing articles 2;
- rotating the drum 4 in order to distribute the solvent on the articles 2;
- causing a drying air flow to circulate along a closed circuit 37 the drum 4 forms part of in order to dry the solvent from the articles 2;
- heating the air circulating in the closed circuit 37 upstream of the drum 4 and cooling the same air downstream of the drum 4;
- varying the speed of air circulation along the closed circuit 37 during the step of circulating a flow of drying air along the closed circuit 37.

It should be noted that, in more general terms, the method involves varying the speed of air circulation along the closed circuit 37.

In the embodiment described above and illustrated in FIGS. 1 and 2, this step is implemented by varying the speed of the fan 17.

The step of varying the speed of air circulation along the closed circuit 37, however, might also be implemented in other ways, for example by causing a part of the air to circulate in a bypass circuit or by activating additional load losses along the closed circuit 37.

It should be noted that the above described method and the machine 1 significantly reduce the odour level of the garments 2.

Moreover, when the solvent used in the machine 1 is the innovative solvent mentioned above, optimum results in cleaning the garments can be obtained with a limited impact on the environment.

One advantage of this invention is that it provides a dry-cleaning method and machine which allow the concentration of residual solvent on the garments at the end of the dry-cleaning cycle to be greatly reduced.

Another advantage of the invention is that it provides a dry-cleaning method and machine which can optimize the duration of the step of drying the articles.

The invention described above is susceptible of industrial application and may be modified and adapted in several ways without thereby departing from the scope of the inventive concept. Moreover, all details of the invention may be substituted by technically equivalent elements.

The invention claimed is:

1. A dry cleaning method for articles, comprising:

feeding a solvent into a drum for containing articles;

rotating the drum in order to distribute the solvent on the articles;

causing a drying air flow to circulate along a closed circuit including the drum, in order to dry the solvent from the articles;

heating the air circulating in the closed circuit upstream of the drum and cooling the same air downstream of the drum;

varying a speed of air circulation along the closed circuit during the circulating the air flow along the closed circuit;

detecting a value of solvent concentration in the air circulating in the closed circuit, wherein the varying the speed of air circulation along the closed circuit comprises varying the speed of air circulation according to the detected value of solvent concentration in the air circulating in the closed circuit, wherein the solvent is dibutoxymethane.

2. The method according to claim 1, wherein the varying the speed of air circulation along the closed circuit is implemented by varying a speed of a fan causing the air circulation.

3. The method according to claim 2, wherein the varying the speed of air circulation along the closed circuit comprises, in order:

maintaining the speed of air circulation along the closed circuit above a first given speed value for a time corresponding to reaching a given value of solvent concentration in the air;

reducing the speed of air circulation along the closed circuit.

4. The method according to claim 3, wherein the reducing the speed of air circulation along the closed circuit comprises progressively reducing the speed of air circulation along the closed circuit to a second given speed value.

5. The method according to claim 4, wherein the reducing the speed of air circulation along the closed circuit is followed by maintaining the speed of air circulation along the closed circuit at a second given speed value.

6. The method according to claim 5, and further comprising cooling the same air downstream of the drum with cooling device built into a cooling circuit; and sealing closed a portion of the closed circuit at an end of the circulating the air flow along the closed circuit, the portion of the closed circuit sealing closed comprising the drum and not comprising the cooling device.

7. The method according to claim 6, and further comprising causing an air flow to circulate along a secondary closed circuit including a filter, the secondary closed circuit comprising the drum.

8. The method according to claim 7, wherein the causing the air flow to circulate along the secondary closed circuit is performed simultaneously with the sealing closed the portion of the closed circuit.

9. The method according to claim 1, wherein, the varying the speed of air circulation along the closed circuit comprises, in order:

maintaining the speed of air circulation along the closed circuit above a first given speed value for a time corresponding to reaching a given value of solvent concentration in the air;

reducing the speed of air circulation along the closed circuit.

10. The method according to claim 9, wherein the reducing the speed of air circulation along the closed circuit comprises progressively reducing the speed of air circulation along the closed circuit to a second given speed value.

11. The method according to claim 10, wherein the reducing the speed of air circulation along the closed circuit is followed by maintaining the speed of air circulation along the closed circuit at a second given speed value.

12. The method according to claim 1, and further comprising cooling the same air downstream of the drum with a cooling device built into a cooling circuit; and sealing closed a portion of the closed circuit at an end of the circulating the air flow along the closed circuit, the portion of the closed circuit sealing closed comprising the drum and not comprising the cooling device.

13. The method according to claim 12, and further comprising causing an air flow to circulate along a secondary closed circuit including a filter, the secondary closed circuit comprising the drum.

14. The method according to claim 6, and further comprising detecting the value of solvent concentration in the air circulating in the closed circuit at a position downstream of the drum and upstream of the cooling device.

15. The method according to claim 1, and further comprising detecting the value of solvent concentration in the air circulating in the closed circuit with a sensor positioned downstream of the drum and upstream of the cooling.

16. The method according to claim 1, and further comprising detecting the value of solvent concentration in the air circulating in the closed circuit with a sensor.

17. The method according to claim 1, and further comprising:

causing the drying air flow to circulate with a fan;

positioning the fan downstream of the cooling and upstream of the heating.

* * * * *